US005375792A

United States Patent [19]

Grau

[11] Patent Number: 5,375,792

[45] Date of Patent: Dec. 27, 1994

[54] METHOD FOR REDUCING DISPERSION IN GUN LAUNCHED PROJECTILES

[75] Inventor: John C. Grau, Sussex, N.J.

[73] Assignee: The United States of America as represented by the Secretary of the Army, Washington, D.C.

[21] Appl. No.: 221,127

[22] Filed: Mar. 31, 1994

[51] Int. Cl.[5] ..... F42B 10/00

[52] U.S. Cl. ..... 244/3.22

[58] Field of Search ..... 244/3.22, 3.21; 102/520, 521

[56] References Cited

U.S. PATENT DOCUMENTS 5,103,735 4/1992 Kaste et al. ..... 102/521

*Primary Examiner*—Daniel T. Pihulic

*Attorney, Agent, or Firm*—Saul Elbaum; Edward Goldberg; Michael C. Sachs

[57] ABSTRACT

Disclosed is a method for reducing dispersion in gun launched projectiles. An axial thrust is applied to the projectile at a specific time in the yaw cycle to cancel the effect of aerodynamic jump which arises from the effect of yawing motion disturbance created by an initial disturbance.

16 Claims, 5 Drawing Sheets

METHOD FOR REDUCING DISPERSION IN GUN LAUNCHED PROJECTILES

BACKGROUND OF THE INVENTION

1. Field of the Invention

The present invention relates to ordnance and more particularly to methods for controlling the trajectories of gun launched projectiles.

2. Brief Description of the Prior Art

In the firing of gun launched projectiles, a phenomenon known as dispersion in which a scattered pattern of hits of shots fired from the same gun with the same firing data will often result. A major contributor to such dispersion is another phenomenon known as "jump" which is discussed in detail below but which may, for example, result from motion imparted to the projectile by the motion of the gun itself by way of recoil. While the correction of jump induced dispersion would be desirable in indirect fire area weapons, it is particularly desirable in direct fire weapons such as tank munitions where first round hits on a target may often be critical.

The introduction of armor-piercing fin-stabilized discarding sabot (APFSDS) kinetic energy ammunition has yielded large improvements in the terminal effectiveness of tank gunnery. By launching a massive high fineness ratio rod at hypervelocity, it became possible to deliver tremendous energy on the target with unprecedented accuracy. The high velocity and resultant short time of flight to target of the APFSDS allows extremely flat trajectories which are insensitive to contributors to inaccuracy such as meteorological conditions, ranging error, velocity variations, and the like.

Since the fielding of the first generation APFSDS ammunition, a number of new generations of APFSDS ammunition have been developed. With each new generation of ammunition, the armor penetration capability has been increased. These increases in armor penetration have been achieved mainly by increasing the mass and fineness ratio of the penetrator rods. Improvements in ammunition structural design and propulsion systems enable these more massive penetrators to be launched at velocities equal to or greater than those of the original APFSDS ammunition.

In order for APFSDS ammunition to be fired effectively to longer distances than current engagement ranges, its delivery accuracy must be improved. If substantial improvements to accuracy are sought, the major contributors to delivery system inaccuracy must be addressed. When the delivery inaccuracy of a tank main armament system is broken down into its component sources, "jump" is found to be a major contributor. In the present report, "jump" refers to a launch induced veering of the trajectory from the expected flight path based on the static pointing direction of the gun muzzle. Jump itself can be broken down into a number of components, one of which is aerodynamic jump. These components are described in further detail in the following references:

Plostins, P., "Launch Dynamics of APFSDS Ammunition," Ballistic Research Laboratory, Aberdeen Proving Ground, Md., BRL-TR-2595, October 1984.

Plostins, P., White, C. O., "The Transitional Ballistics, Aeroballistics and Jump of a 25mm-AP Training Projectile with Base Bleed," Proceedings of the Tenth International Symposium. on Ballistics, American Defense Preparedness Association, 1987.

Plostins, P., Celmins, I., Bornstein, J., Diebler, J. E., "The effect of Sabot Front Borerider Stiffness on the Launch Dynamics of Fin-Stabilized Kinetic Energy Ammunition," Ballistic Research Laboratory, Aberdeen Proving Ground, Md., BRL-TR-3047, October 1989.

Schmidt, E. M., Bornstein, J. A., Plostins, P., Haug, B., Brosseau, T. L., "Jump From M1A1 Tank," Ballistic Research Laboratory, Aberdeen Proving Ground, Md., BRL-TR-3144, September 1990 (hereafter "Schmidt").

SUMMARY OF THE INVENTION

It is an object of the present invention to provide a means for canceling or reducing the effects of aerodynamic jump in a gun launched projectile.

When a statically stable projectile such as a APFSDS kinetic energy projectile is launched with an angular disturbance (that is, there is an angular rate of rotation about an axis other than the projectile longitudinal axis), it begins to undergo an epicyclic yawing motion. The aerodynamic forces associated with the yawing motion will cause the flight path to veer through an angle known as the aerodynamic jump angle which is described in further detail in Murphy, C. H., "Free Flight Motion of Symmetric Missiles," Ballistic Research Laboratory, Aberdeen Proving Ground, Md., BRL-TR-1216, July 1963. Because the magnitude and direction of the launch disturbance varies from shot to shot and occasion to occasion, the magnitude and direction of the aerodynamic jump also varies, resulting in a scatter of shots on the target, known as dispersion. The present method for canceling aerodynamic jump takes advantage of the fact that the magnitude and direction of both the yawing motion and the aerodynamic jump are fixed by the magnitude and direction of the initial launch disturbance. The method comprises applying an axial thrust on the projectile in a direction which diminishes the effect of the initial yaw.

Preferably this cancellation is achieved by applying the thrust early in the trajectory when the projectile is yawed in a direction roughly opposite to the direction of the aerodynamic jump. That is, the initial disturbance will be an angular disturbance which will result in an epicyclic yawing motion in which the yaw progresses through a first local maximum yaw and a second local maximum yaw and the axial thrust is applied at the second local maximum yaw. Alternatively, the yaw progresses through a first local maximum yaw and through a series of successive local maximum yaws in which alternate local maximum yaws are in a direction opposite from the first local maximum yaw and in which the axial thrust is applied at about one of the local maximum yaws which are opposite in direction from the first local maximum yaw. The initial yaw has an amplitude having a magnitude which is proportional to the initial disturbance, and the axial thrust is applied at one of said local maximum yaws. As a result of this positioning of the application of the axial thrust, it will be appreciated that the axial thrust uniformly compensates for said initial yaw regardless of variations in the initial disturbance either in terms of magnitude or direction.

The axial thrust is applied for a short time duration and is preferably applied with a rocket, and the time for which axial thrust is applied is approximately equal to the burn time. In practice it will preferably be applied so that the burn time approaches one-half of a yaw period. The method may be used with either a direct fire munitions projectile or a indirect fire munitions projectile but will be most advantageously used with those projectiles in which aerodynamic jump is a significant contributor to dispersion. Such projectiles in which this method may be particularly effectively used include armor-piercing fin-stabilized discarding sabot (APFSDS) kinetic energy projectiles, tank fired high explosive projectiles and air defense canon projectiles. In general, it is contemplated that the method may be used on any larger caliber projectiles, but it is also believed to be applicable for use on small arms weapons projectiles. The term "gun" as used herein is intended to encompass any tube weapon including not only guns, as used in the sense of a high projectile velocity and flat trajectory weapon, but also howitzers and mortars.

BRIEF DESCRIPTION OF THE DRAWINGS

The present invention is further described with reference to the accompanying drawings in which.

DETAILED DESCRIPTION

Nomenclature used in the description the method of the present invention is shown in the following Table 1.

TABLE 1

| Nomenclature | |
|---|---|
| $C_D$ | Drag coefficient |
| $C_{L\alpha}$ | Lift coefficient slope |
| $C_{M\alpha}$ | Pitching moment coefficient slope |
| $C_{Mq} + C_{M\dot{\alpha}}$ | Pitch damping moment coefficient |
| $C_{n\alpha}$ | Normal force coefficient slope |
| | d reference diameter |
| $I_y$ | Transverse moment of inertia |
| $I_{Total}$ | Total impulse |
| $m_o$ | Initial mass |
| $m_p$ | Propellant mass |
| S | Reference area |
| $V_o$ | Initial velocity |
| $\Delta V$ | Change in velocity |
| $\delta_{2nd}$ | Second local maximum yaw angle |
| $\dot{\delta}_o$ | Initial yaw rate |
| $\rho$ | Air density |
| $\theta_j$ | Aerodynamic jump |

Figure 1:
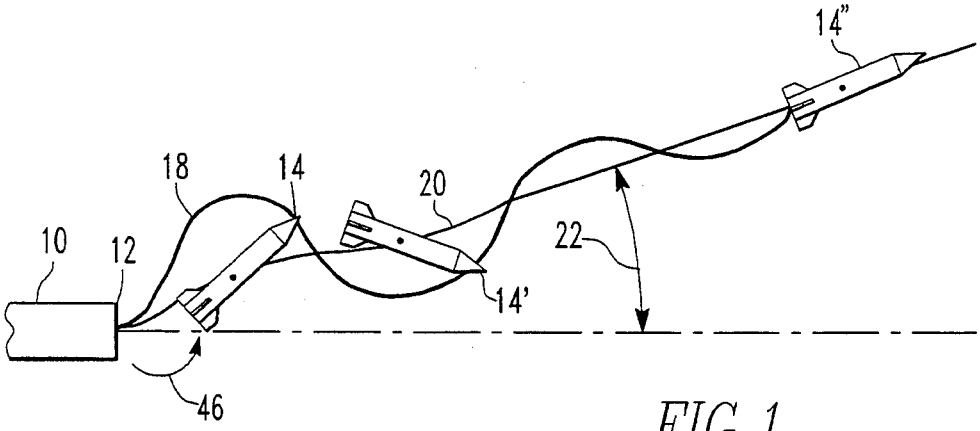
FIG. 1 PRIOR ART
FIG. 1 is a schematic illustration showing the aerodynamic jump of a projectile under a prior art case.

Referring to FIG. 1, a projectile is launched from a gun 10 having a muzzle 12 with a "nose-up" angular rate. This causes the projectile nose to begin to rotate upwardly in an epicyclic yawing motion whereby the amplitude of the yawing motion is proportional to the magnitude of the initial disturbance. The position of the projectile at three successive positions is shown respectively at numerals 14, 14' and 14''. A muzzle disturbance 16 results in an initial yaw 18. The resultant aerodynamic lift will cause the trajectory 20 to veer upwardly through the aerodynamic jump angle 22 which can be expressed in simplified form by Equation (1).

$$\theta_J = \frac{C_{L\alpha}}{C_{M\alpha}} \frac{I_y}{m_o d V_o} \dot{\delta}_o \tag{1}$$

Like the yawing motion, the aerodynamic jump is also directly proportional to the magnitude of the initial disturbance.

Figure 2:
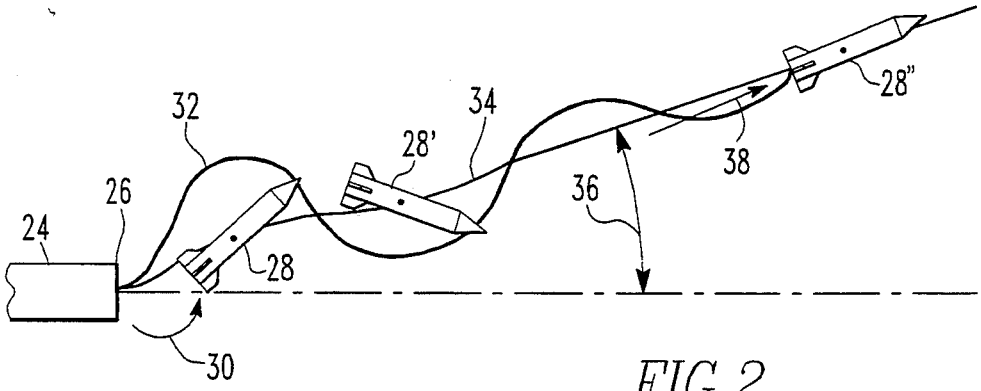
FIG. 2 PRIOR ART
FIG. 2 is a schematic illustration showing the aerodynamic jump of a projectile under another prior art case.

Referring to FIG. 2, the effect of aerodynamic jump on existing gun launched rocket assisted projectile systems is illustrated. A gun 24 having a muzzle 26 launches a projectile shown in three successive positions at numerals 28, 28' and 28''. A disturbance 30 causes an initial yaw 32 resulting in a veering trajectory 34 and aerodynamic jump 36. An axial thrust 38 is applied after several yaw cycles. At the point that this thrust is applied the longitudinal axis of the projectile is nearly aligned with the flight direction. Accordingly the application of the axial thrust at this point does not significantly alter the flight path direction. Whatever aerodynamic jump which was induced by launch disturbances is virtually unaltered by the rocket thrust so that these projectile systems have jump induced dispersion which is nearly equivalent to a non thrusting system.

Figure 3:
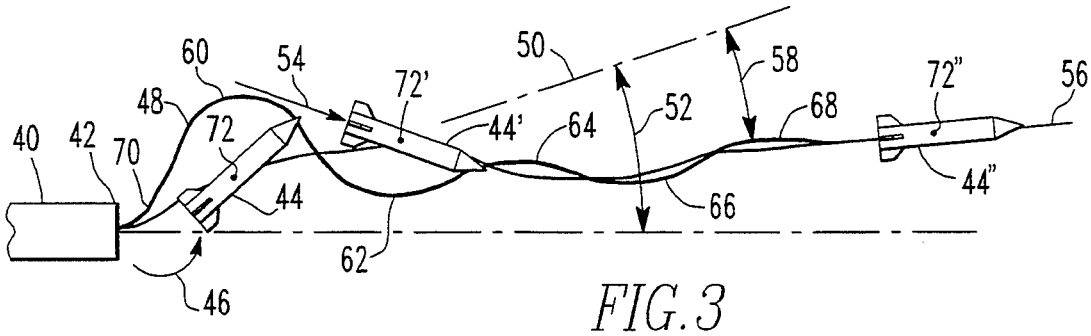
FIG. 3 is a schematic illustration showing aerodynamic jump cancellation by application of axial thrust by means of the method of the present invention.

Referring to FIG. 3, the method of the present invention is illustrated. In this case a gun 40 having a muzzle 42 launches a projectile shown in three successive positions at numerals 44, 44' and 44''. A disturbance 46 results in an initial yaw 48 which absent any correction would result in a veering trajectory 50 and aerodynamic jump 52. Correction, however, is accomplished by means of thrust 54 which results in a corrected trajectory 56 and a reduction in jump 58. It will also be observed that there is a first local maximum yaw 60, a second local maximum yaw 62 and a series of successive local maximum yaws as at 64, 66 and 68. It will be understood that the curve 70 (as well as the corresponding curves in FIGS. 1 and 2) schematically represents the angular amount of yaw at a particular position when the center of gravity of the projectile as at 72, 72' and 72'' is at the corresponding position on the trajectory and not the actual position of any part of the projectile. The axial thrust is applied at the second local maximum yaw which is opposite in direction relative to the intended flight path from the direction of the first local maximum yaw. Alternatively, the axial thrust may be applied at any of the successive local maximum yaws as at 66 which are also opposite in direction from the first local maximum yaw. To express the position of applying this axial thrust in other terms, the angular sum of the direction of the local maximum initial yaw as at 60 and the direction of the axial thrust as at 62 will approximate the intended flight path of the trajectory which is generally the same trajectory as corrected trajectory 56.

The jump causes the projectile to hit above the intended impact point on the target. In FIG. 3, the projectile is launched with the same initial disturbance as in FIG. 1. For a slowly spinning projectile such as a typical APFSDS kinetic energy projectile, the resulting epicyclic yawing motion is nearly planar. Therefore, at the second local maximum yaw point in the trajectory the projectile nose is pointed away from the direction of the aerodynamic jump. If axial thrust is applied to the projectile near this point, the thrust will cause the trajectory to veer downwardly toward the initial line of fire and impact the target closer to the intended impact point. Thus the application of axial thrust effectively cancels a portion of the aerodynamic jump and reduces target impact dispersion. Because the magnitude of both the yawing motion and aerodynamic jump are proportional to the magnitude of the initial disturbance, the amount of jump cancellation achieved will be proportional to the size of the jump itself. Rounds with large initial disturbances will undergo large amplitude yawing motion and therefore will experience a large jump cancellation to cancel the large aerodynamic jump. Rounds with little initial disturbance will undergo small amplitude yawing motion and therefore we will experience a small jump cancellation to cancel the small aerodynamic jump. Also, the direction of both the yawing motion and the aerodynamic jump are fixed by the direction of the initial disturbance. Therefore the trajectory veering caused by the application of thrust will always be in the proper direction to cancel the aerodynamic jump. The aerodynamic jump cancellation is therefore self compensating for varying aerodynamic jump magnitude and direction.

EXAMPLE 1

This is an example of a procedure by which one skilled in the art might select a suitable rocket engine for use in the method of the present invention. To determine the appropriate size for a rocket engine which would be required, a generic APFSDS kinetic energy projectile configuration was selected. Projectile flight behavior was modeled using a six-degrees of freedom (6-DOF) trajectory simulation computer program as is taught by Fiorellini, A. J., Grau, J., "An Upgraded Version of the Six- Degree-of-Freedom Trajectory Simulation Computer Program TRAJ"—December 1992 Release, Armament Research Development and Engineering Center, Picatinny Arsenal, New Jersey, ASB-IR-08-92, December 1992. Such a trajectory simulation may be utilized to study the effects of thrust magnitude, duration and timing on the jump cancellation. It was assumed that an impulsive thrust applied at exactly the second local maximum yaw point would be optimum for canceling aerodynamic jump. At this point in time the projectile would be oriented at the largest angle in a direction opposite to the jump. If all of the motor impulse could be applied instantaneously in this orientation the maximum change to the velocity vector would result. The change in velocity due to the instantaneous application of motor impulse can be expressed by Equation (2).

$$\Delta V = \frac{I_{Total}}{m_p} \ln\left(\frac{m_o}{m_o - m_p}\right) \tag{2}$$

The amount of rocket motor impulse required to cancel all of the aerodynamic jump for this optimum case can be estimated using equation (2) in conjunction with the expression for second maximum yaw (3) and the jump equation (1).

$$\delta_{2nd} = \frac{2\dot{\delta}_o d}{H\omega V_o}\,\theta^{-H(3\pi/4\omega)} \tag{3}$$

where;

$$H = \frac{\rho S d}{2m_o}\left(C_{N\alpha} - 2C_D - \frac{m_o d^2}{I_y}(C_{Mq} + C_{M\alpha})\right)$$

$$\omega = \sqrt{\frac{\rho S d^3}{2I_y} C_{M\alpha}}$$

Total impulse required to cancel such aerodynamic jump would be calculated using the following Equation (4).

$$I_{Total} = \frac{\Theta_J V_o M_p}{(\delta_{2nd} - \Theta_J)\ln\left(\frac{m_o}{m_o - m_p}\right)} \tag{4}$$

For the generic kinetic energy projectile, a total impulse of 20.9 lbf-sec applied instantaneously at the second maximum yaw point (0.044 seconds) would be required to cancel all of the aerodynamic jump. With a rocket motor specific impulse of 220 lbf-sec/lbm, 0.095 pounds of propellant would be required to provide this total impulse. For a typical propellant density of 0.063 pounds per cubic inch, the required propellant would occupy a volume of 1.5 cubic inches. Of course, in actual practice it will not be possible to deliver the impulse this efficiently (instantaneously), and therefore 0.095 pounds of propellant should be thought of as a lower limit on the amount of propellant required to achieve total aerodynamic jump cancellation.

EXAMPLE 2

Figure 4:
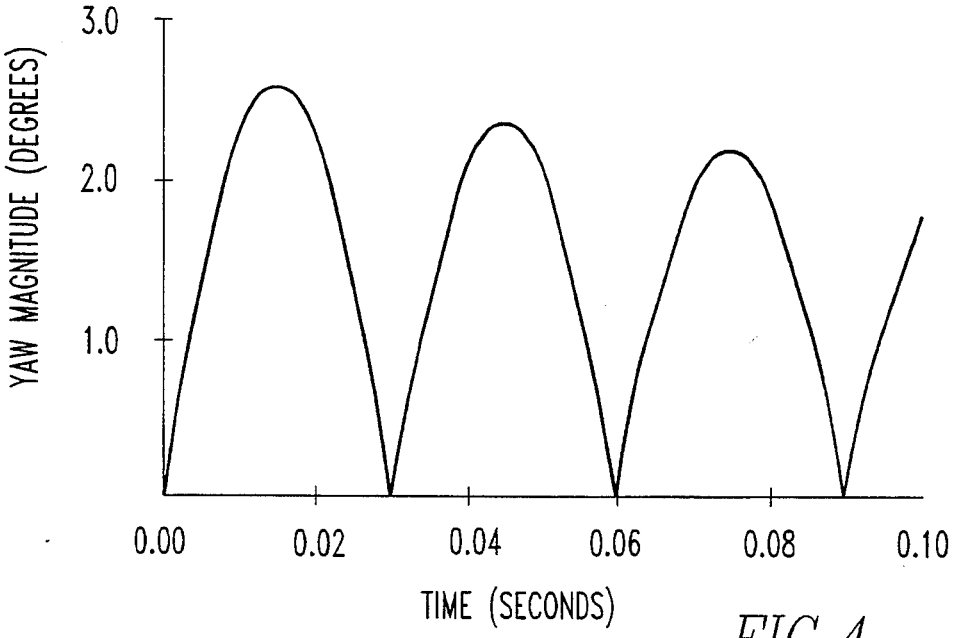
FIG. 4 is a graph showing total yaw magnitude vs. time in a non thrusting case.
Figure 5:
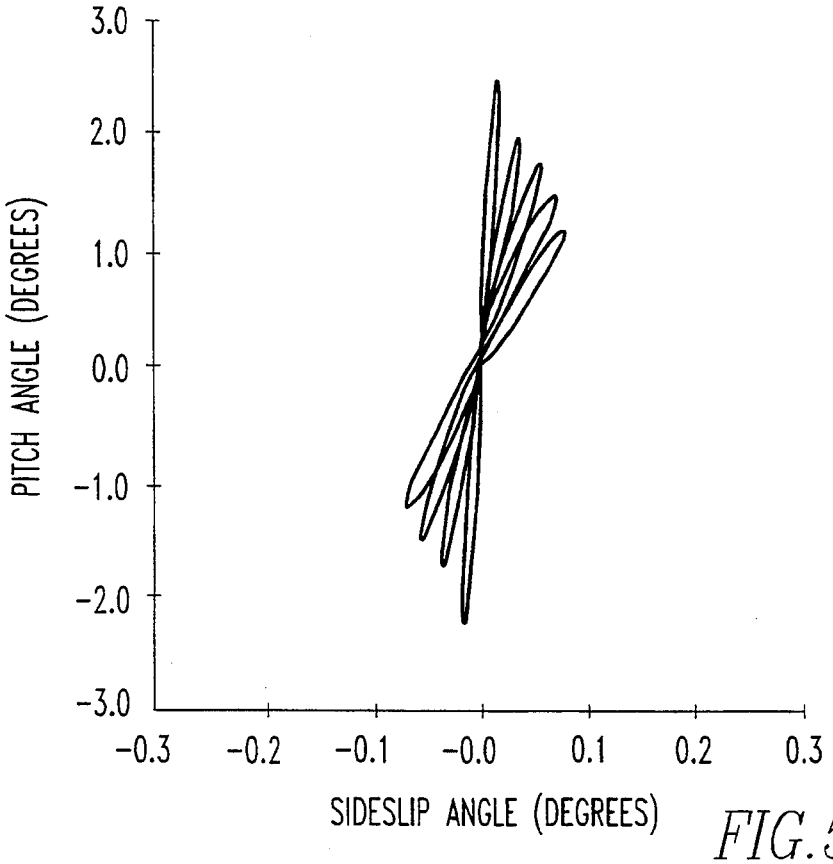
FIG. 5 is a graph showing epicyclic motion in a non thrusting case.

This is an example of a procedure by which an appropriate burn time may be selected for the rocket engine selected in Example 1 or other appropriate rocket engine. In this example, the length of burn time was selected by using the 6-DOF simulation. Trajectory simulation results showing total yaw versus time and epicyclic motion for a non-thrusting case are presented as FIGS. 3 and 4 respectively. In order to efficiently cancel jump, the application of rocket motor thrust should be limited to the second half period of yaw. Thrust applied before or after this time is essentially wasted as it acts to increase rater than decrease the jump. This effect is apparent in FIG. 6 where the rocket motor impulse required to cancel the jump is plotted versus burn duration. These 6-DOF simulation results were obtained by selecting a burn time and adjusting the motor ignition time and thrust level to cancel all of the jump. Instantaneous application of the motor impulse is the most efficient for canceling jump; however, the impulse required increases relatively slowly with increasing burn duration until the burn time approaches the yaw half period (0.030 seconds). Further increases in burn time would greatly increase the motor impulse requirements to achieve the jump cancellation. Those skilled in the art will appreciate that although short burn times are most efficient for canceling jump from an impulse standpoint; short burn times must be accompanied by high thrust levels in order to provide the impulse required to cancel the aerodynamic jump. High thrust levels mean high motor chamber pressure which imposes increased structural requirements and therefore increased weight. At some point, the increased structural weight will exceed the weight of motor propellant which is saved by decreasing the burn time. Although there may be an optimum motor burn time from an overall motor weight standpoint, this optimum time will be dependent upon the particular structural design of the rocket motor selected for use.

EXAMPLE 3

Figure 6:
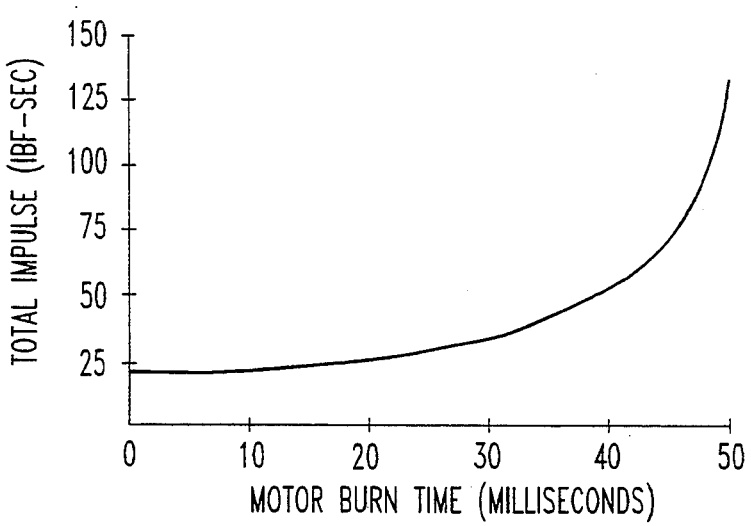
FIG. 6 is a graph showing total impulse required to cancel aerodynamic jump as a function of rocket burn time.

In this example, the effect of timing errors is considered. Another concern with an aerodynamic jump canceling rocked motor is the sensitivity of the jump cancellation to ignition timing errors. Igniting the motor at an improper time will result in less than optimum jump cancellation. If the ignition timing error is large enough, the rocket motor effect on the trajectory will actually add to the jump and increase dispersion. In FIG. 6 the effect of motor ignition timing errors is presented for three different jump canceling rocket motor designs. The three motor designs were; 10 millisecond burn time and 2180 pounds of thrust (21.8 lbf-sec impulse), 30 millisecond burn time and 1103 pounds of thrust (33.1 lbf-sec impulse) and 50 millisecond burn time and 2638 pounds of thrust (131.9 lbf- sec). The net deviation of the trajectory (aerodynamic jump minus the correction produced by the motor) is plotted versus motor ignition time for each of the designs. Although each of the three motors have different optimum ignition times (0.039 sec for 10 msec burn time, 0.029 sec for 30 msec burn time, and 0.019 sec for 50 msec burn time), they all have nearly identical sensitivities to ignition timing errors. For each of the designs, a 0.015 second timing error results in no aerodynamic jump cancellation. Timing errors larger than this would cause the thrust to actually act to increase the jump. Those skilled in the art will appreciate that the ignition system for this type of rocket motor must be capable of igniting the motor within several milliseconds of the optimum ignition time.

EXAMPLE 4

Figure 7:
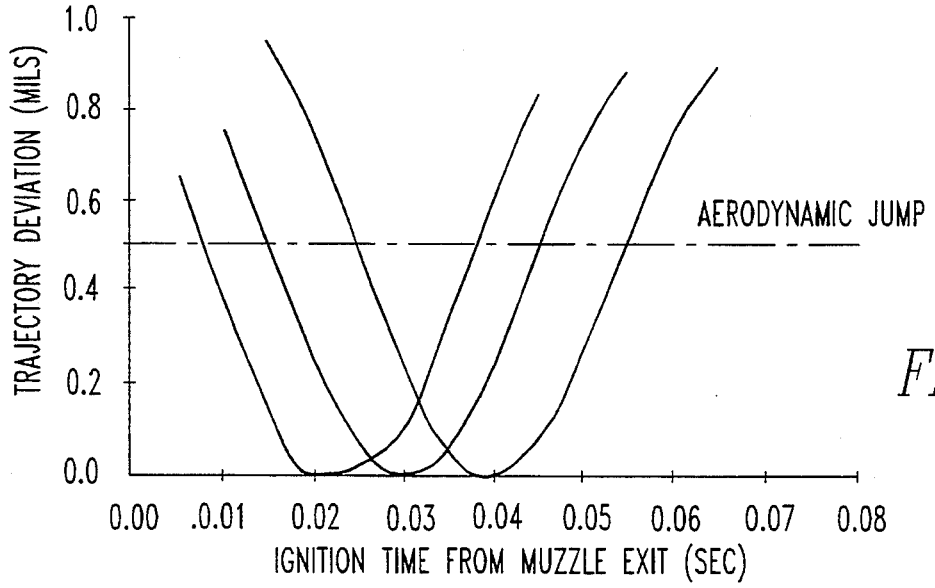
FIG. 7 is a graph showing the effect of rocket motor ignition timing on aerodynamic jump cancellation.

This example discloses further aspects of the practice of the method of this invention relative to the selection of a rocket motor. Those skilled in the art will appreciate that the design of a jump canceling rocket motor will involve a compromise between motor efficiency and structural weight. As a starting point for this example, a motor burn time equal to the yaw half period (0.030 seconds) was selected. To achieve total aerodynamic jump cancellation with this burn time, a total impulse of 33.1 lbf-sec is required. Accordingly, the motor thrust was set to 1103 lbf. The optimum ignition delay time for this motor was determined to be 0.029 seconds through 6-DOF simulation. Given a propellant specific impulse of 220 lbf-sec/lbm, 0.15 pounds of propellant would be required. The corresponding propellant volume would be 2.4 cubic inches. Of course, additional volume would be required for port volume, an exhaust nozzle, and motor chamber structure. It does appear that the motor volume will be small enough such that it can be reasonably integrated into a typical kinetic energy projectile design. Preferably the motor would be incorporated into a flared fin hub assembly. Simulation results which illustrate the aerodynamic jump cancellation for the generic kinetic energy projectile equipped with this jump canceling rocked motor are presented as FIG. 7. The projectile yaw, motor thrust, and trajectory deflection are plotted on the same time scale for a case in which the projectile is launched with a 5 radian per second yaw rate. The trajectory veers from the intended line of flight at the aerodynamic jump angle. Applying thrust over the second half period of yaw causes the trajectory to veer back toward the intended line of flight.

TEST

In this test estimates of the potential benefits of this method are made. The delivery accuracy measure of merit for a tank main armament system is the first shot hit probability. The most frequently quoted type of hit probabilities are the "quasi-combat stationary to stationary" first shot hit probabilities as is disclosed by Pfleger, K. "Methodology for Tank Delivery Accuracy Evaluations" Armament Research, Development and Engineering Center, Picatinny Arsenal, New Jersey ARFSD-TR-92003, August 1992 (hereafter "Pfleger"). These values are intended to represent the probability of a particular type of stationary tank main armament system achieving a first round hit on a standard size stationary target at a particular engagement range for a typical worldwide range of combat conditions. The hit probabilities are calculated using a fixed set of factors such as; environmental variations, human factors, firing platform and ammunition variabilities which have been determined to be the important degraders of weapon system delivery accuracy. The variabilities of these factors are represented by Gaussian distributions whose mean values and standard deviations for a particular firing platform and ammunition type have been established through testing. A list of the contributing factors (Table 2) and their statistics, commonly referred to as an error budget, for the generic kinetic energy projectile of the present study fired from a state of the art main battle tank is presented by V. The effect of each of these factors on target impact accuracy at a particular range are combined in a root sum squared manner to obtain the total weapon system dispersion. System impact distribution is then integrated over the standard target dimensions to obtain the quasi-combat hit probability. All hit probabilities in the current study were calculated using this methodology.

TABLE 2

| Variables Considered in First Shot Hit Probability Calculations | |
|---|---|
| Drift | Earth Rate |
| Jump | Wind |
| Fleet Variation | Air Temperature |
| Parallax | Air Density |
| Fire Control | Optical path bending |
| Ranging | Gun Laying |
| Cant | Visual resolution |
| Muzzle velocity | Ammunition |
| Site Angle | |

Figure 8A:
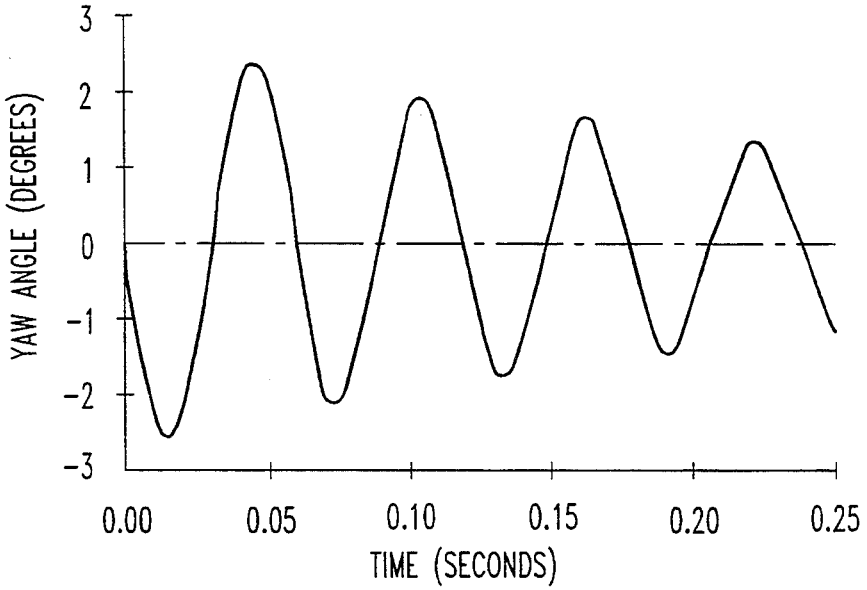
FIGS. 8*a*, 8*b* and 8*c* are graphs respectively showing yaw angle, thrust and deflection vs. time for jump canceling projectiles.
Figure 8B:
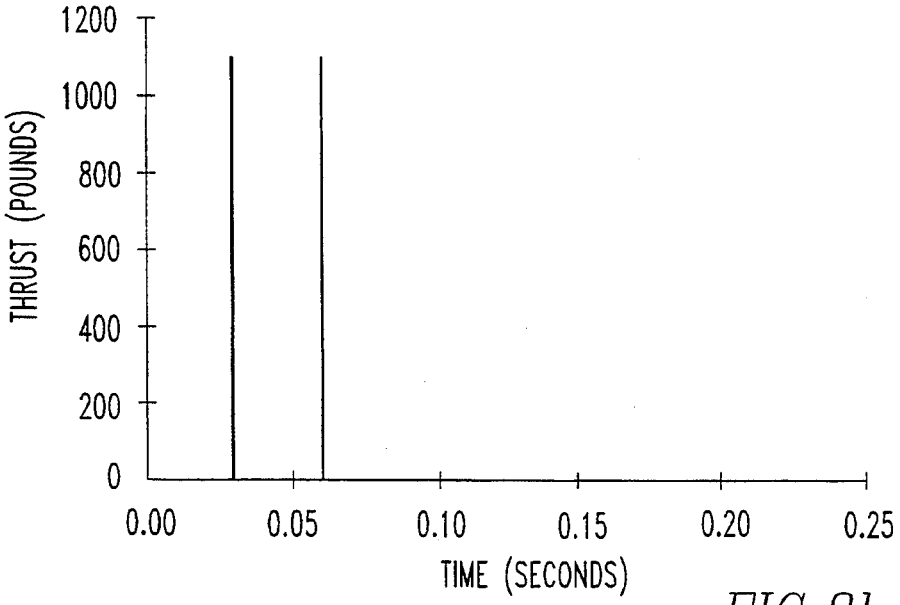
Figure 8C:
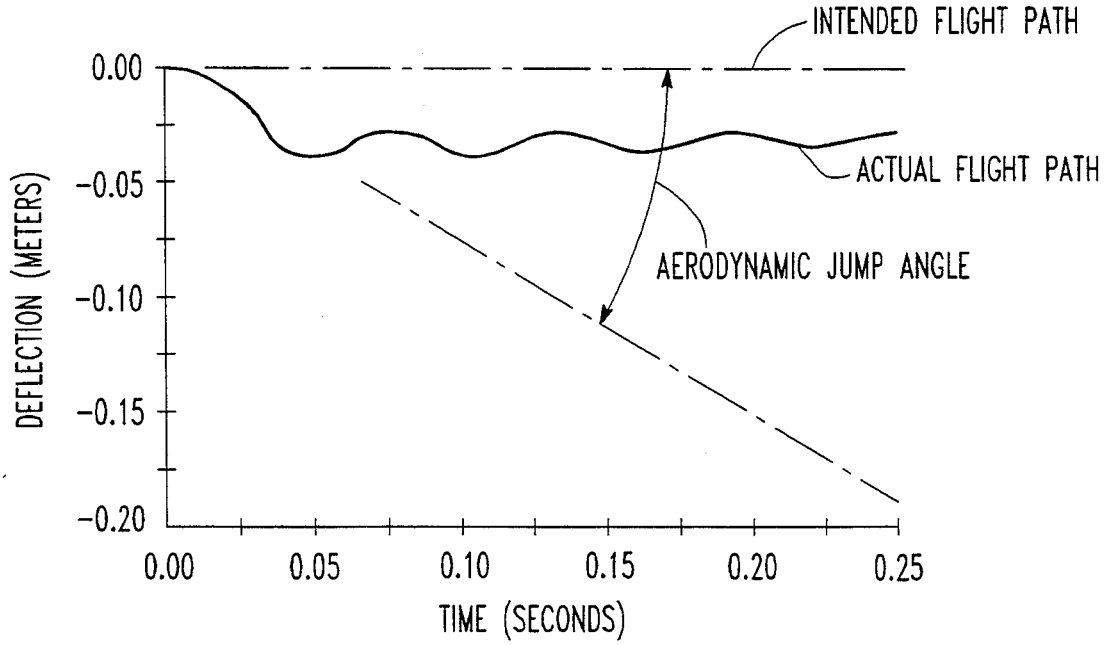
Figure 9:
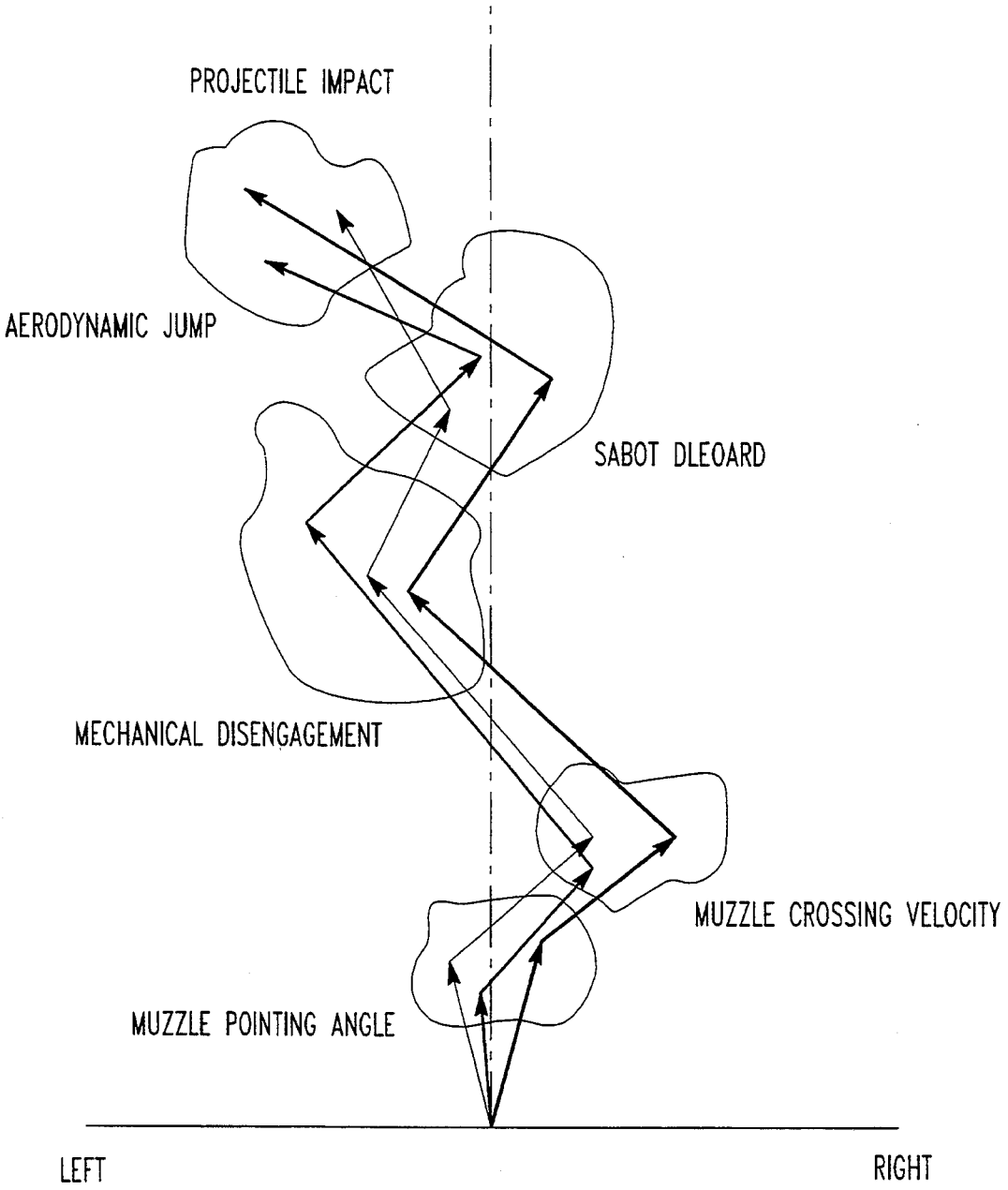
FIG. 9 is a schematic illustration showing various jump components.

Jump (total jump as defined above) is responsible for three of the error contributions listed in Table 1. The contributor titled "jump" is actually occasion to occasion variation in jump, the contribution titled "fleet variation" is the vehicle to vehicle variation in jump, and the contributor titled "ammunition" is the projectile to projectile variation in jump. An aerodynamic jump canceling projectile system will act to reduce each of these variabilities. The amount of reduction will depend upon what fraction of jump is aerodynamic jump. The error budget does not include statistics for the sub-components of jump such as aerodynamic jump. However, the four references discussed above in the Brief Description of the Prior Art present the results of detailed experimental investigations into the makeup of jump. It has been determined that the jump of APFSDS kinetic energy ammunition is made up of five major components; muzzle pointing angle jump, muzzle crossing velocity jump, mechanical disengagement or center of gravity jump, sabot discard jump , and aerodynamic jump. The manner in which these five components contribute to total jump and jump variability is illustrated in FIG. 8. In Schmitt et al. this type of data is presented for two different large caliber APFSDS projectile designs fired from three different gun tubes which is the most comprehensive statistical data available on the contribution of aerodynamic jump to overall jump for this type of projectile. The data in this reference was used as a guide in generating the aerodynamic jump contributions to the error budget. The procedure for generation the aerodynamic jump contributions to the error budget involved comparing each of the five jump components (muzzle pointing angle, muzzle crossing velocity, mechanical disengagement, sabot discard, aerodynamic jump) for each test shot to the total jump for the particular shot. By pooling the data for all test shots, statistics were obtained which related the magnitude and direction of each of the jump components to the magnitude and direction of the total jump. The known statistics for the total jump contributions to the error budget (V) were utilized in a Monte Carlo procedure which selected total jump values for individual shots. The Monte Carlo procedure would then be employed again to break the total jump for a particular shot into components. This was done by imputing into the Monte Carlo procedure would output values for the magnitude and direction of the particular jump component of interest, in this case aerodynamic jump, for each shot. By pooling these values for a group of shots or group of occasions the statistical contributions of the particular jump component to the error budget are obtained. Knowing these statistics, the effect on hit probability of altering the jump components can be calculated. This Monte Carlo procedure has been set up as a preprocessor for the six- degree-of-freedom trajectory simulation computer program. The Monte Carlo procedure is utilized to generate initial conditions for the trajectory simulation such that the complete weapon system dispersion can be modeled. Effects of variations on environmental factors, human factors, firing vehicle and gun factors and variations in rocket motor timing and performance are also considered in the simulation. Because the motor ignition system has not yet been developed, its accuracy was treated parametrically in the simulation. Standard deviations in ignition time of 0.0015 seconds, and 0.0073 seconds (5% and 25% of optimum ignition time respectively) were considered. Results indicate that the amount of aerodynamic jump cancellation achieved is not appreciably affected by changes in ignition timing error of the magnitude considered. The overall contribution of aerodynamic jump to system dispersion was reduced from 0.433 mils for the generic APFSDS projectile, to 0.334 mils with ignition timing errors of either 0.0015 seconds or 0.0073 seconds. The impact of canceling aerodynamic jump on first shot hit probability is illustrated in FIG. 9. Simulation results are plotted showing the percentage improvement in hit probability for the jump canceling projectile as compared to the generic kinetic energy projectile versus target range. Canceling the aerodynamic jump clearly provides significant improvement in hit probability, particularly at the longer engagement ranges.

Those skilled in the art will appreciate that the employment of the method of the present invention will potentially significantly improve the accuracy of APFSDS type kinetic energy ammunition. It will also be appreciated that the use of this method is not necessarily limited to this type of ammunition. Using a rocket motor to cancel aerodynamic jump may prove advantageous for other projectile types if aerodynamic jump is a significant contributor to system dispersion. Such additional projectile types include direct fire munitions such tank fired high explosives projectiles and air defense canon projectiles.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method for reducing dispersion relative to other similarly launched projectiles in a gun launched projectile having a flight attitude on a trajectory wherein said dispersion results from an initial disturbance acting on the projectile upon muzzle launch to establish an initial yaw in the flight attitude of said projectile comprising the step applying an axial thrust on the projectile in a direction which diminishes the effect of said initial yaw.

2. The method of claim 1 wherein the initial disturbance is an angular disturbance.

3. The method of claim 2 wherein the projectile undergoes an epicyclic yawing motion.

4. The method of claim 3 wherein the yaw progresses through a first local maximum yaw and a second local maximum yaw and the axial thrust is applied at the second local maximum yaw.

5. The method of claim 3 wherein the yaw progresses through a first local maximum yaw and through a series of successive local maximum yaws in which alternate local maximum yaws are in a direction opposite from the first maximum yaw and in which axial thrust is applied at about one of the local maximum yaws which are opposite in direction from the first local maximum yaw.

6. The method of claim 5 wherein the axial thrust is applied early in the trajectory.

7. The method of claim 5 wherein the initial yaw has an amplitude having a magnitude which is proportional to the initial disturbance and the axial thrust is applied at one of said local maximum yaws such that said axial thrust uniformly compensates for said initial yaw regardless of variations in the initial disturbance.

8. The method of claim 5 wherein the axial thrust is applied for a short time duration.

9. The method of claim 8 wherein axial thrust is applied with a rocket having a burn time and the time for which axial thrust is applied is approximately equal to said burn time.

10. The method of claim 9 wherein there is a yaw period through which the projectile passes and the burn time approaches one-half of a yaw period.

11. The method of claim 1 wherein the projectile is a direct fire munitions projectile.

12. The method of claim 11 wherein aerodynamic jump is a significant contributor to dispersion.

13. The method of claim 11 wherein the projectile is an armor-piercing fin-stabilized discarding sabot (APFSDS) kinetic energy projectile.

14. The method of claim 11 wherein the projectile is a high explosive tank fired projectile.

15. The method of claim 11 wherein the projectile is an air defense canon projectile.

16. The method of claim 1 wherein the projectile is an indirect fire weapon projectile.

* * * * *